US007731340B2

(12) United States Patent
Katayama et al.

(10) Patent No.: US 7,731,340 B2
(45) Date of Patent: Jun. 8, 2010

(54) LIQUID JETTING HEAD AND METHOD FOR PRODUCING THE SAME

(75) Inventors: Naoki Katayama, Kariya (JP); Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 818 days.

(21) Appl. No.: 11/513,403

(22) Filed: Aug. 31, 2006

(65) Prior Publication Data

US 2007/0195131 A1 Aug. 23, 2007

(30) Foreign Application Priority Data

Aug. 31, 2005 (JP) ..... 2005-250797

(51) Int. Cl.
*B41J 2/045* (2006.01)

(52) U.S. Cl. ..... 347/71

(58) Field of Classification Search ..... 347/68–72
See application file for complete search history.

(56) References Cited

U.S. PATENT DOCUMENTS

2002/0036678 A1* 3/2002 Ito et al. ..... 347/71
2005/0011071 A1 1/2005 Kanada et al.
2005/0068377 A1* 3/2005 Ishikawa et al. ..... 347/68

FOREIGN PATENT DOCUMENTS

| | | | |
|---|---|---|---|
| EP | 1083048 | A1 | 3/2001 |
| JP | H09-141853 | A | 6/1997 |
| JP | H11-348276 | A | 12/1999 |
| JP | 2005022174 | A | 1/2005 |

* cited by examiner

*Primary Examiner*—Stephen D Meier
*Assistant Examiner*—Geoffrey Mruk
(74) *Attorney, Agent, or Firm*—Baker Botts, LLP.

(57) ABSTRACT

An ink-jet head includes a channel unit and a piezoelectric actuator. The channel unit has a plurality of plates made of metal and including a cavity plate which is made of metal and in which a plurality of pressure chambers are formed and a supply plate which is made of metal and in which holes communicating with the pressure chambers respectively are formed, and the plates are diffusion-bonded with each other. The piezoelectric actuator has a vibration plate which is diffusion-bonded with the cavity plate. A groove is formed in a partition wall defining the pressure chambers or in an area overlapping the partition wall of the vibration plate, the cavity plate, and the supply plate. There is provided a liquid jetting head in which air hardly remains in the pressure chambers, and deterioration of jetting performance by the air is suppressed.

15 Claims, 11 Drawing Sheets

LIQUID JETTING HEAD AND METHOD FOR PRODUCING THE SAME

CROSS-REFERENCE TO RELATED APPLICATIONS

The present application claims priority from Japanese Patent Application No. 2005-250797 filed on Aug. 31, 2005, the disclosure of which is incorporated herein by reference in its entirety.

BACKGROUND OF THE INVENTION

1. Field of the Invention

The present invention relates to a liquid jetting head which jets liquid and a method of producing the same.

2. Description of the Related Art

As a liquid jetting head, for example, there is an ink-jet head which jets ink. The ink-jet head has a plurality of complicated and elaborate ink channels inside. Such an ink-jet head is formed, for example, by stacking thin etching plates. For securely bonding the stacked etching plates with one another, it is conceivable to bond the plates using, for example, an adhesive that is epoxy based, acrylic based or the like. However, when the amount of an adhesive applied is large, the adhesive may flow into an ink channel or the like in the head to narrow or block the ink channel. Accordingly, there is proposed an ink-jet head in which an upper structure formed by diffusion-bonding four plates, a manifold bonded body formed by diffusion-bonding three manifold plates, and a lower structure formed by diffusion-bonding two plates are bonded together with an adhesive (see US 2005/011071 A1). With this method, it is possible to prevent the adhesive from narrowing or blocking an ink channel, and also it is possible to securely bond the respective plates forming the upper structure and the lower structure because the manifold bonded body having manifolds formed inside is formed in a separate step from that of forming other structures.

SUMMARY OF THE INVENTION

However, in the above technique described in US 2005/011071A1, in a state that a cavity plate having a plurality of pressure chambers formed inside, a base plate, an aperture plate and a supply plate are stacked in this order from the top, an upper surface (outside surface) of the cavity plate and a lower surface (outside surface) of the supply plate are heated while being sandwiched by flat surfaces of jigs and pressed in the stacking direction, and the cavity plate and the supply plate are thereby diffusion-bonded together to form the upper structure. At this time, for a space between the cavity plate and the base plate, the pressing force is sufficiently transferred to the base plate in a center portion of a partition wall defining pressure chambers, but the pressing force is not sufficiently transferred to the base plate in the vicinity of a wall surface of the partition wall defining the pressure chambers. Thus, there is a fear that the diffusion-bonding is carried out in a state that the base plate and a portion in the vicinity of the wall surface of the partition wall are not in contact. Consequently, in the peripheral area of a pressure chamber between the cavity plate and the base plate, a gap continuing to the pressure chamber is formed in some cases. When ink is filled in an ink-jet head having such a gap and air enters this gap, then it is difficult to discharge the air even by purging, and the air remains inside the pressure chamber. When pressure is applied to the ink in the pressure chamber to jet the ink from a nozzle, with the air staying inside the pressure chamber, the air absorbs the pressure applied. As a result, desired ink jetting performance cannot be obtained.

Accordingly, an object of the present invention is to provide a liquid jetting head which makes it difficult for air to stay inside a pressure chamber, thereby suppressing deterioration of liquid jetting performance, and to provide a method of producing the same.

According to a first aspect of the present invention, there is provided a liquid jetting head which jets liquid, including: a channel unit formed by diffusion-bonding plates including a pressure chamber plate made of metal in which a plurality of pressure chambers defined by a partition wall are formed along a plane, and a plurality of channel plates which are made of metal and stacked on a side of one surface of the pressure chamber plate, the channel plates being formed with channels communicating with the pressure chambers; and a piezoelectric actuator which selectively changes volumes of the pressure chambers and which has a vibration plate made of metal and diffusion-bonded on the other surface of the pressure chamber plate to cover the pressure chambers, a piezoelectric layer arranged in the vibration plate on a side opposite to the pressure chambers, and a plurality of individual electrodes arranged in the piezoelectric layer at an area on a side opposite to the pressure chambers and facing the pressure chambers, wherein a space is formed in an overlapping area, of the vibration plate, the pressure chamber plate, or one of the channel plates, which overlaps the partition wall in a direction orthogonal to the plane.

Accordingly, since the space is formed, when the pressure chamber plate is sandwiched and pressed by the vibration plate and the channel plates, the pressing force concentrates on spaces between wall surface-vicinity areas in one and the other surfaces of the pressure chamber plate and areas in the vibration plate and the channel plates which overlap the wall surface-vicinity areas in a direction orthogonal to the plane, thereby bonding the areas securely. Accordingly, when the vibration plate, the pressure chamber plate and the channel plates are diffusion-bonded, the wall surface-vicinity areas of the pressure chamber plate, the vibration plate and the channel plates are bonded securely without a gap. Therefore, any gap continuing to the periphery of the pressure chamber is hardly formed, thereby eliminating any defect related to remaining air, which is conventionally regarded as a problem. Here, the term "the overlapping area" of a plate which overlaps the partition wall means an area sandwiched by virtually extended planes extending wall surfaces of the partition wall, and the space is formed in an area separated and away from the wall surfaces of the partition wall and the virtually extended planes.

In the liquid jetting head according to the present invention, the space may be formed in the vibration plate. The liquid jetting head partially deforms the vibration plate and the piezoelectric layer which face the pressure chambers to change the volumes of the pressure chambers, thereby applying pressure to liquid inside the pressure chambers. Accordingly, when the space is formed in the vibration plate, the area of the vibration plate at which the space is formed has a decreased thickness. Then, the partial deformation of the vibration plate and the piezoelectric layer facing a certain pressure chamber is hardly propagated to a portion facing another pressure chamber adjacent to the certain pressure chamber. Therefore, crosstalk can be suppressed. In addition, areas in the vicinity of wall surfaces of the partition wall (wall surface-vicinity areas) on the other surface of the pressure chamber plate and areas in the vibration plate which overlap the wall surface-vicinity areas in the pressure chamber plate in the direction orthogonal to the plane are bonded securely.

Accordingly, it is possible to stabilize the deformation of the vibration plate and the piezoelectric layer facing the pressure chambers.

In the liquid jetting head according to the present invention, the space may be defined by a groove formed in a surface of the vibration plate which faces the piezoelectric layer. Accordingly, when the piezoelectric layer is formed on the surface of the vibration plate opposite to the pressure chambers, a groove corresponding to the groove formed in the vibration plate is also formed in the piezoelectric layer. Consequently, since the area of the piezoelectric layer in which the groove is formed has a thickness smaller than other areas in the piezoelectric layer, the crosstalk can be suppressed.

In the liquid jetting head according to the present invention, a width of the space may be 50% to 80% of a width of a portion of the partition wall which separates two pressure chambers among the pressure chambers and adjacent to each other, the width being in a direction connecting the two pressure chambers. Accordingly, the vibration plate and the wall surface-vicinity areas of the pressure chamber plate can be bonded securely.

In the liquid jetting head according to the present invention, the space may be formed in the pressure chamber plate. Accordingly, the wall surface-vicinity areas in the pressure chamber plate, the vibration plate and the channel plates are bonded securely.

In the liquid jetting head according to the present invention, the space may be defined by a groove formed in the one surface of the pressure chamber plate. Accordingly, the wall surface-vicinity areas in the pressure chamber plate and the channel plates are bonded securely.

In the liquid jetting head according to the present invention, the space may be defined by a groove formed in the other surface of the pressure chamber plate. Accordingly, the wall surface-vicinity areas in the pressure chamber plate and the vibration plate are bonded securely.

In the liquid jetting head according to the present invention, the space may be formed in the channel plates. Accordingly, the channel plates and the wall surface-vicinity areas in the pressure chamber plate are bonded securely.

In the liquid jetting head according to the present invention, the pressure chambers may construct a pressure chamber row arranged in one direction along the plane; and the space may be formed in the overlapping area of the vibration plate, the pressure chamber plate, or one of the channel plates, outside of the pressure chambers at both ends of the pressure chamber row in the one direction. Accordingly, even when a plurality of pressure chambers are arranged to form a pressure chamber row, areas, of the pressure chamber plate, outside the pressure chambers at both ends of the pressure chamber row, are bonded securely with the vibration plate and the channel plates.

In the liquid jetting head according to the present invention, the individual electrodes may be arranged on a surface of the piezoelectric layer opposite to the vibration plate to sandwich the piezoelectric layer with the vibration plate. Accordingly, formation of the piezoelectric actuator becomes easy.

In the liquid jetting head according to the present invention, each of the pressure chambers has a slender shape, and the space may be formed in the overlapping area of the vibration plate, the pressure chamber plate, or one of the channel plates, in a longitudinal direction of the pressure chambers. Alternatively, the space may be formed in the overlapping area of the vibration plate, the pressure chamber plate, or one of the channel plates, along a periphery of the pressure chamber. Still alternatively, the space may be formed as a group of non-continuous spaces arranged in a row in the overlapping area of the vibration plate, the pressure chamber plate, or one of the channel plates. In any of the cases, in the overlapping area of the vibration plate, the pressure chamber plate, or one of the channel plates, these plates can be bonded securely.

In the liquid jetting head according to the present invention, the space may be formed on a center in a width direction of the overlapping area of the vibration plate, the pressure chamber plate, or one of the channel plates. When bonding these plates, pressure is applied in good balance to the overlapping areas of these plates, and thus these plates can be bonded securely.

According to a second aspect of the present invention, there is provided a method of producing a liquid jetting head which includes: a channel unit including a pressure chamber plate which is made of metal and in which a plurality of pressure chambers defined by a partition wall are formed along a plane, and a plurality of channel plates which are made of metal and stacked on a side of one surface of the pressure chamber plate, the channel plates being formed with channels communicating with the pressure chambers; and a piezoelectric actuator which selectively changes volumes of the pressure chambers and which has a vibration plate made of metal and arranged to cover the pressure chambers, a piezoelectric layer arranged in the vibration plate on a side opposite to the pressure chambers, and a plurality of individual electrodes arranged in the piezoelectric layer at an area facing the pressure chambers and on a side opposite to the pressure chambers, the method including: a step for providing a plurality of plates for forming the vibration plate, the pressure chamber plate, and the channel plates; a plate forming step for forming the vibration plate, the pressure chamber plate, and the channel plates from the plates, the plate forming step including a space forming step for forming a space by forming a groove or a through hole in one of the plates, which are to be the vibration plate, the pressure chamber plate, and the channel plates respectively, so that a space is formed in an area overlapping the partition wall in a direction orthogonal to the plane when the plates are stacked; a stacking step for stacking the vibration plate, the pressure chamber plate, and the channel plates; and a bonding step for diffusion-bonding the vibration plate, the pressure chamber plate, and the channel plates by applying pressure in a direction of stacking in the stacking step to form a stack.

According to the second aspect of the present invention, since the space is formed, the wall surface-vicinity areas, in one and/or the other surface of the pressure chamber plate and an area of at least one of the vibration plate and the channel plates, which overlaps the wall surface-vicinity areas in the direction orthogonal to the plane can be brought into contact and bonded in the bonding step. Accordingly, any gap continuing to the periphery of the pressure chamber is hardly formed, thereby making it possible to provide a liquid jetting head in which any defect related to remaining air regarded as a problem conventionally is eliminated. Here, the space is formed in areas of the plates to be the vibration plate, the pressure chamber plate, and the channel plates, which are separated and away from the wall surfaces of the partition wall and the virtually extended planes extending the wall surfaces of the partition wall.

In the method of producing the liquid jetting head according to the present invention, in the space forming step, the space may be formed in the vibration plate. The liquid jetting head partially deforms the vibration plate facing the pressure chambers and the piezoelectric layer to change the volumes of the pressure chambers, thereby applying pressure to liquid inside the pressure chambers. When the space is formed in the vibration plate in the gap forming step, the area of the vibration plate at which the space is formed has a decreased thickness. Then, the partial deformation of the vibration plate and the piezoelectric layer, which are facing a certain pressure chamber among the pressure chambers, is hardly propagated to a portion facing another pressure chamber adjacent to the certain pressure chamber. Therefore, the crosstalk can be suppressed. In addition, the wall surface-vicinity areas on the other surface of the pressure chamber plate and areas of the vibration plate which overlap the wall surfaces of the partition wall, in the direction orthogonal to the plane, are bonded securely. Accordingly, since the deformation of the vibration plate and the piezoelectric layer facing the pressure chambers becomes stable, the drive voltage can be lowered and the power consumption can be lowered.

In the method of producing the liquid jetting head according to the present invention, in the space forming step, the space may be formed in the partition wall of the pressure chamber plate. Accordingly, since the space is formed in the pressure chamber plate in the space forming step, the wall surface-vicinity areas in one and the other surfaces of the pressure chamber plate and areas in the vibration plate and the channel plates, which overlap the wall surface-vicinity areas in the pressure chamber plate in the direction orthogonal to the plane, can be bonded securely in the bonding step.

In the method of producing the liquid jetting head according to the present invention, in the space forming step, the space may be formed in the channel plates. Accordingly, since the space is formed in the channel plates in the space forming step, the channel plates and the wall surface-vicinity areas of the pressure chamber plate can be bonded securely in the bonding step.

PREFERRED EMBODIMENT FOR CARRYING OUT THE INVENTION

Hereinafter, a preferred embodiment of the present invention will be explained with reference to the drawings.

Figure 1:
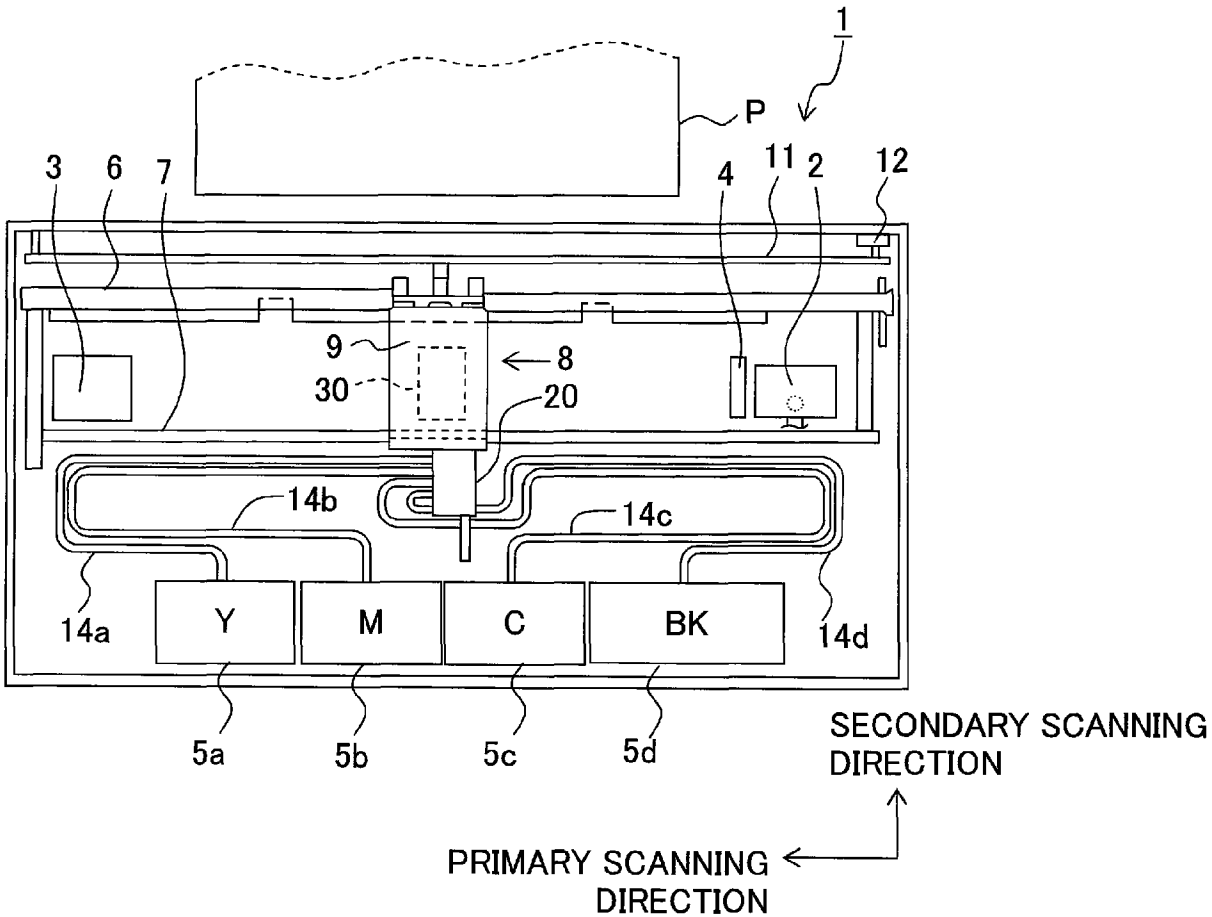
FIG. 1 is a schematic plan view of an ink-jet printer adopting an ink-jet head according to an embodiment of the present invention.

This embodiment is an example in which the present invention is applied to an ink-jet head as a liquid jetting head which jets ink from nozzles to a recording paper. FIG. 1 is a schematic plan view of an ink-jet printer adopting an ink-jet head according to the embodiment of the present invention. Inside the ink-jet printer 1, as shown in FIG. 1, two guide shafts 6, 7 are provided. On these guide shafts 6, 7, a head unit 8 which serves also as a carriage is attached. The head unit 8 includes a head holder 9 formed of a synthetic resin material. The head holder 9 holds an ink-jet head 30 which performs printing by jetting ink onto a print sheet P. The head holder 9 is attached to a belt 11 which is rotated by a carriage motor 12, and the head holder 9 reciprocates in a primary scanning direction along the guide shafts 6, 7 by being driven by the carriage motor 12.

The ink-jet printer 1 is provided with an ink cartridge 5*a* accommodating yellow ink, an ink cartridge 5*b* accommodating magenta ink, an ink cartridge 5*c* accommodating cyan ink, and an ink cartridge 5*d* accommodating black ink. The respective ink cartridges 5*a* to 5*d* are connected to a tube joint 20 by flexible tubes 14*a* to 14*d* respectively. Further, the ink-jet printer 1 is provided with an ink absorbing member 3 to which the head holder 9 faces when the head holder 9 moves to the left end. The ink absorbing member 3 absorbs ink jetted from a nozzle during flushing. Further, the ink-jet printer 1 is provided with a purge unit 2 to which the head holder 9 faces when the head holder 9 moves to the right end. The purge unit 2 absorbs ink from the nozzle during purging. On a left side of the purge unit 2, a wiper 4 which wipes ink adhering on a nozzle surface is provided.

Figure 2:
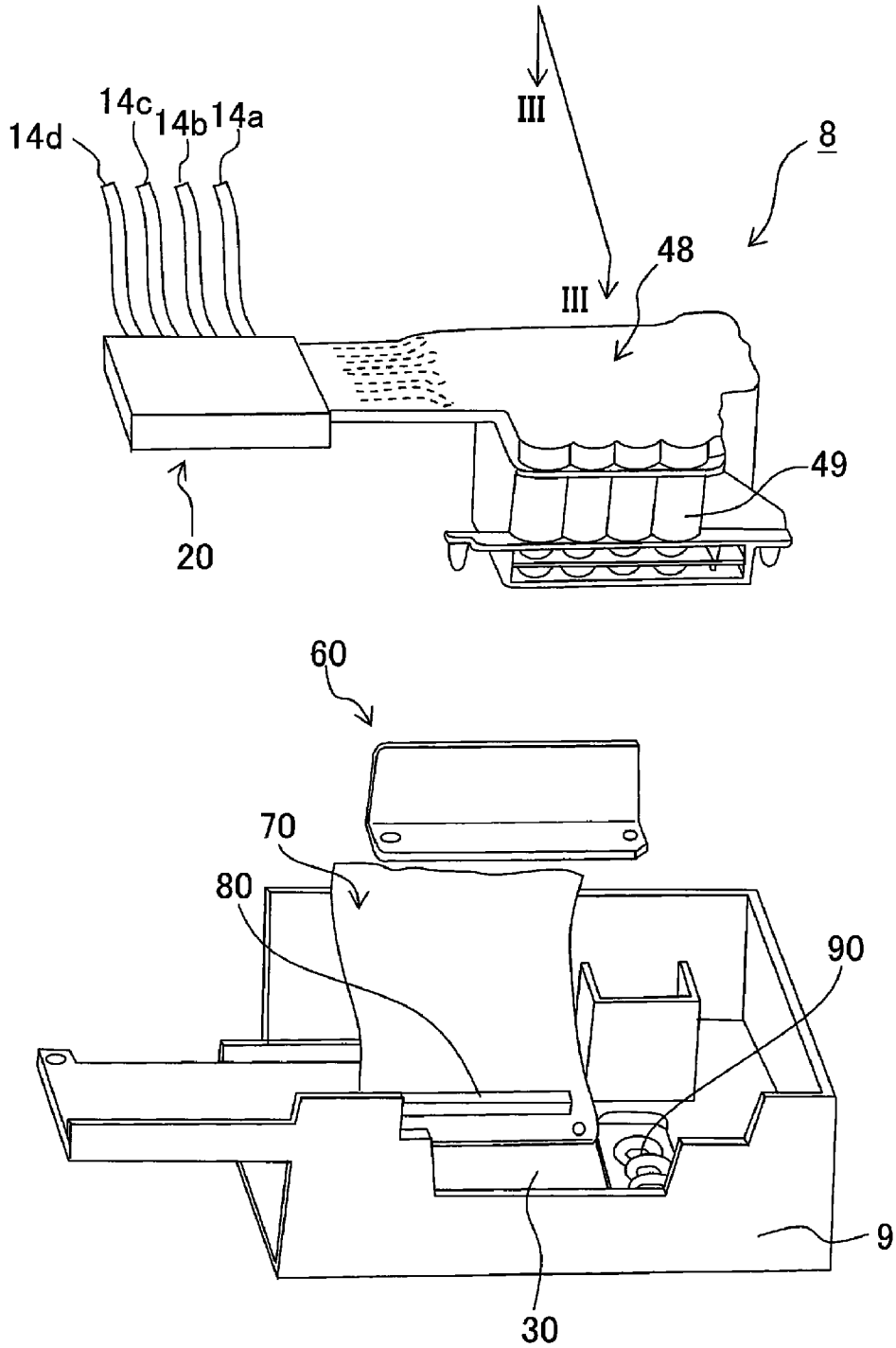
FIG. 2 is an exploded perspective view of a head unit shown in FIG. 1.
Figure 3:
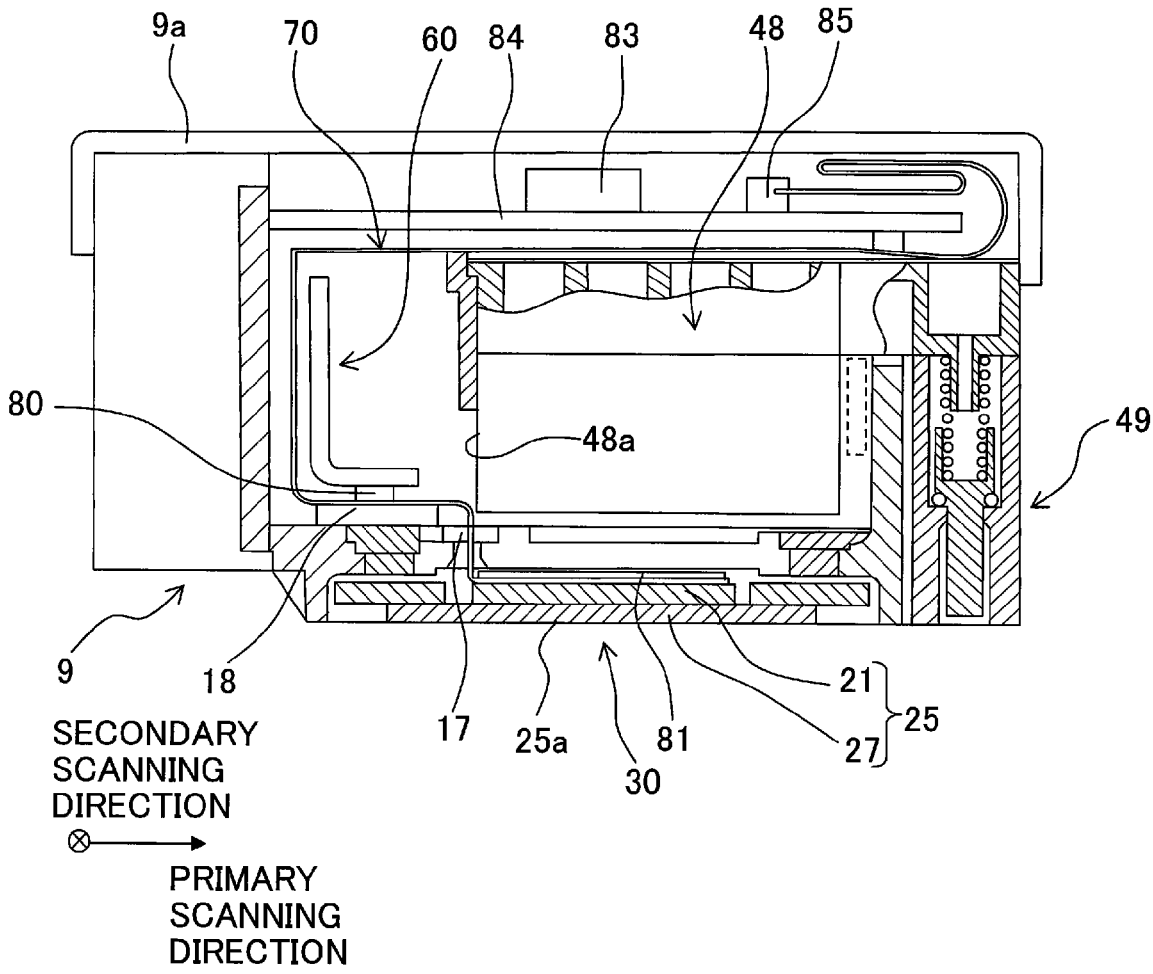
FIG. 3 is a vertical cross-sectional view of the ink-jet head unit shown in FIG. 2.

Next, the main structure of the head unit 8 is explained below. FIG. 2 is an exploded perspective view of the head unit 8 shown in FIG. 1 and shows a state that a buffer tank 48 and a heat sink 60 are removed from the head holder 9. FIG. 3 is a vertical cross-sectional view of the ink-jet head unit shown in FIG. 2 taken along the III-III line in FIG. 2. In FIG. 3, a control board 84 and a cover 9*a*, which are provided above the buffer thank 48 and are omitted in FIG. 2, are shown.

As shown in FIG. 2 and FIG. 3, the head holder 9 is formed in a box shape opening upward. As shown in FIG. 3, on a bottom portion of the head holder 9, a head body 25 included in the ink-jet head 30 is fixed. Further, in the head holder 9, the buffer tank 48 which temporarily stores ink to be supplied to the head body 25 is arranged above the head body 25. The head body 25 is arranged so that an ink jetting surface (bottom surface) 25*a*, in which a plurality of nozzles 28 are formed, is exposed downward outside the head holder 9.

To an end of the buffer tank 48, as shown in FIG. 2, a tube joint 20 for supplying ink to this buffer tank 48 is connected. On a lower surface of the buffer tank 48, four ink outlet ports (not shown) are provided, and the outlet ports are connected via a seal member 90 to four ink supply ports 30*a* (to be described later) provided in the head body 25. As shown in FIG. 3, above the buffer tank 48, the control board 84 is provided, on which electronic parts such as a capacitor 83 and a connector 85 are mounted. An upper side of the control board 84 is covered by the cover 9*a* covering an upper side of the head holder 9.

As shown in FIG. 3, the heat sink 60 having a shape of letter "L" (an L shape) is fixed to the head holder 9 at a position adjacent to a left side wall 48*a* of the buffer tank 48. On a right side of the buffer tank 48, there is provided a jet unit 49 which jets air, accumulated in the buffer tank 48, to the outside.

Figure 4:
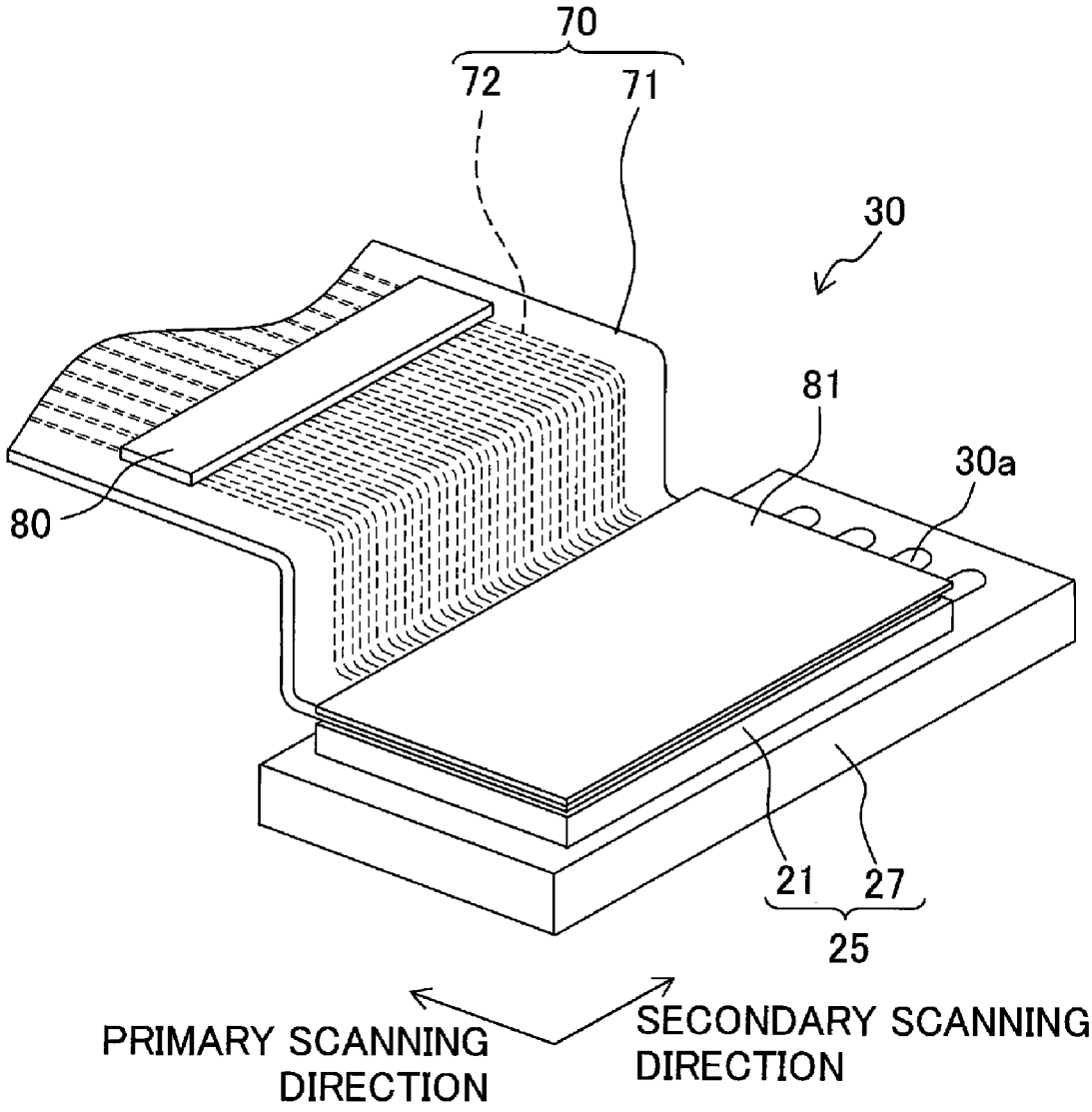
FIG. 4 is a perspective view illustrating an appearance of the ink-jet head.

Next, the main structure of the ink-jet head 30 is explained. FIG. 4 is a perspective view illustrating an appearance of the ink-jet head 30. As shown in FIGS. 3 and 4, the ink-jet head 30 includes the head body 25 and a flexible printed circuit (FPC) 70 bonded on an upper surface of the head body 25. The head body 25 includes a channel unit 27 in which a plurality of ink channels are formed for the colors respectively and a piezoelectric actuator 21 arranged on an upper surface of the channel unit 27. The channel unit 27 and the piezoelectric actuator 21 are both constructed by stacking a plurality of thin plates having a rectangular shape in a plan view, and are arranged below the buffer tank 48. At one end of the head body 25, the four ink supply ports 30*a* having an oval shape in a plan view are formed.

As shown in FIG. 4, the FPC 70 has a base material 71 having flexibility and insulation properties and extending from the piezoelectric actuator 21 to the control board 84, and a plurality of wires 72 formed along an extending direction of the base material 71. On the base material 71, a driver IC 80 is mounted. The wires 72 connect a plurality of individual electrodes 39 which are formed in the piezoelectric actuator 21 respectively and will be explained later, to the driver IC 80, and further electrically connect the driver IC 80 to the control board 84. As shown in FIG. 3, the FPC 70 is drawn out to one side in the primary scanning direction from an upper surface of the piezoelectric actuator 21, and further drawn out upwardly through a hole 17 formed in a bottom portion of the head holder 9 and via a gap formed between the heat sink 60 and a side wall of the head holder 9. Then, the FPC 70 is electrically connected to the connector 85 provided on the control board 84 via a gap between the control board 84 and the buffer tank 48. The driver IC 80 outputs a drive signal to each of the individual electrodes 39 via one of the wires 72, the drive signal being a parallel signal having a predetermined voltage converted from a print signal serially transferred from the control board 84. Further, the driver IC 80 is pressed to contact the heat sink 60 by an elastic member 18 at an intermediate position on an arranging route of the base material 71. Accordingly, excessive heat can be released from the driver IC 80 generating heat.

Further, on an area, of the FPC 70, which faces the piezoelectric actuator 21, an aluminum plate 81 is arranged. The aluminum plate 81 has a rectangular shape with substantially the same size as the upper surface of the piezoelectric actuator 21, and uniformizes heat generated by the respective individual electrodes 39 by driving the actuator so as to prevent fluctuation of the heat.

Figure 5:
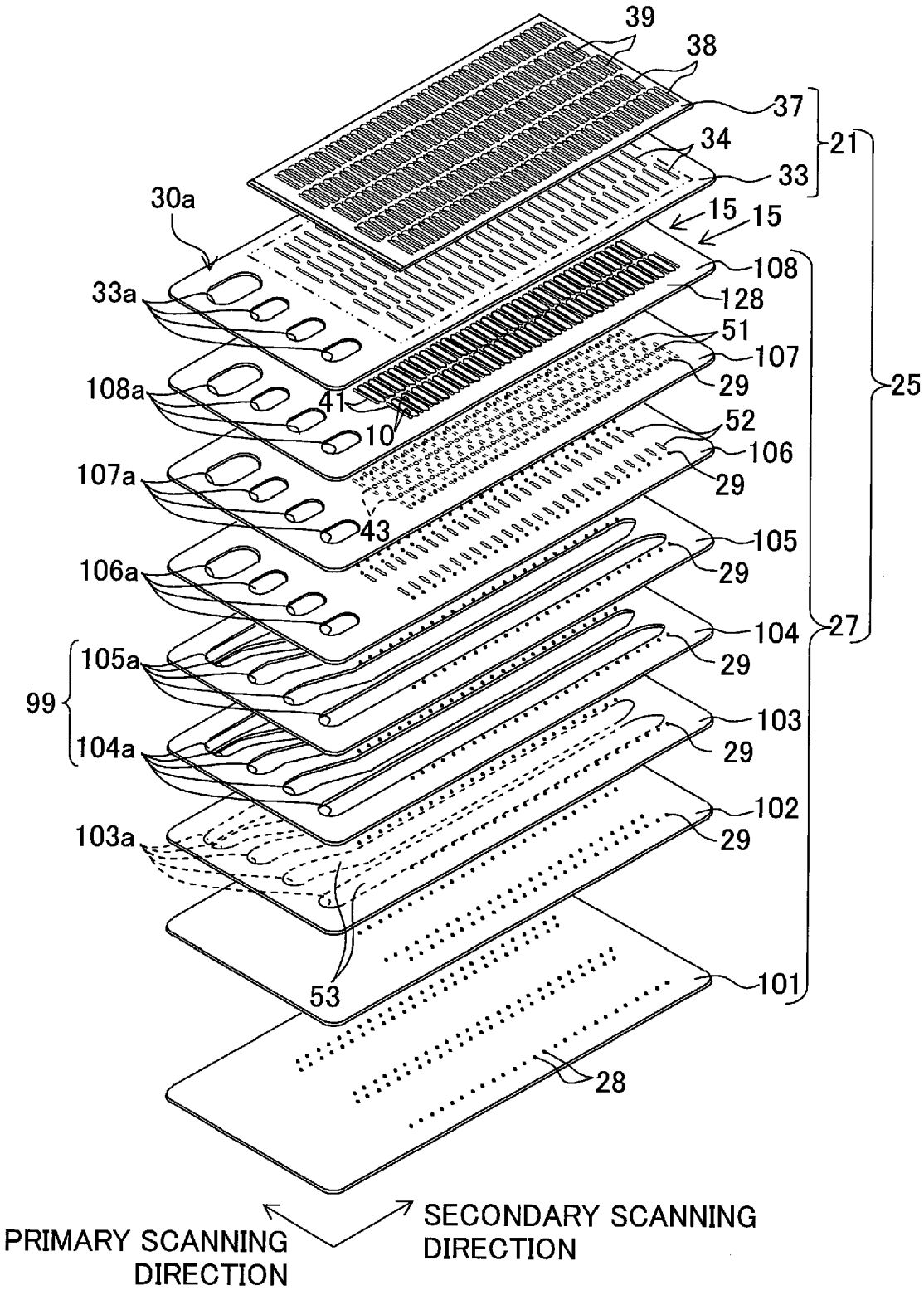
FIG. 5 is an exploded perspective view of a head body.

FIG. 5 is an exploded perspective view of the head body 25. As shown in FIG. 5, the channel unit 27 has a stacked structure of stacking a total of eight sheet materials which are stacked, from an upper side, a cavity plate (pressure chamber plate) 108, a supply plate (channel plate) 107, an aperture plate 106, two manifold plates 105, 104, a damper plate 103, a cover plate 102, and a nozzle plate 101. Each of the plates 101 to 108 has a rectangular shape elongated in a secondary scanning direction in a plan view. In this embodiment, among the eight plates 101 to 108 constructing the channel unit 27, the seven plates 102 to 108 excluding the nozzle plate 101 are made of stainless steel, and the nozzle plate 101 is made of polyimide resin. Note that the respective plates 101 to 108 may be formed of a metal material other than the stainless steel, and the nozzle plate 101 may be formed of a material same as the seven plates 102 to 108.

Figure 6:
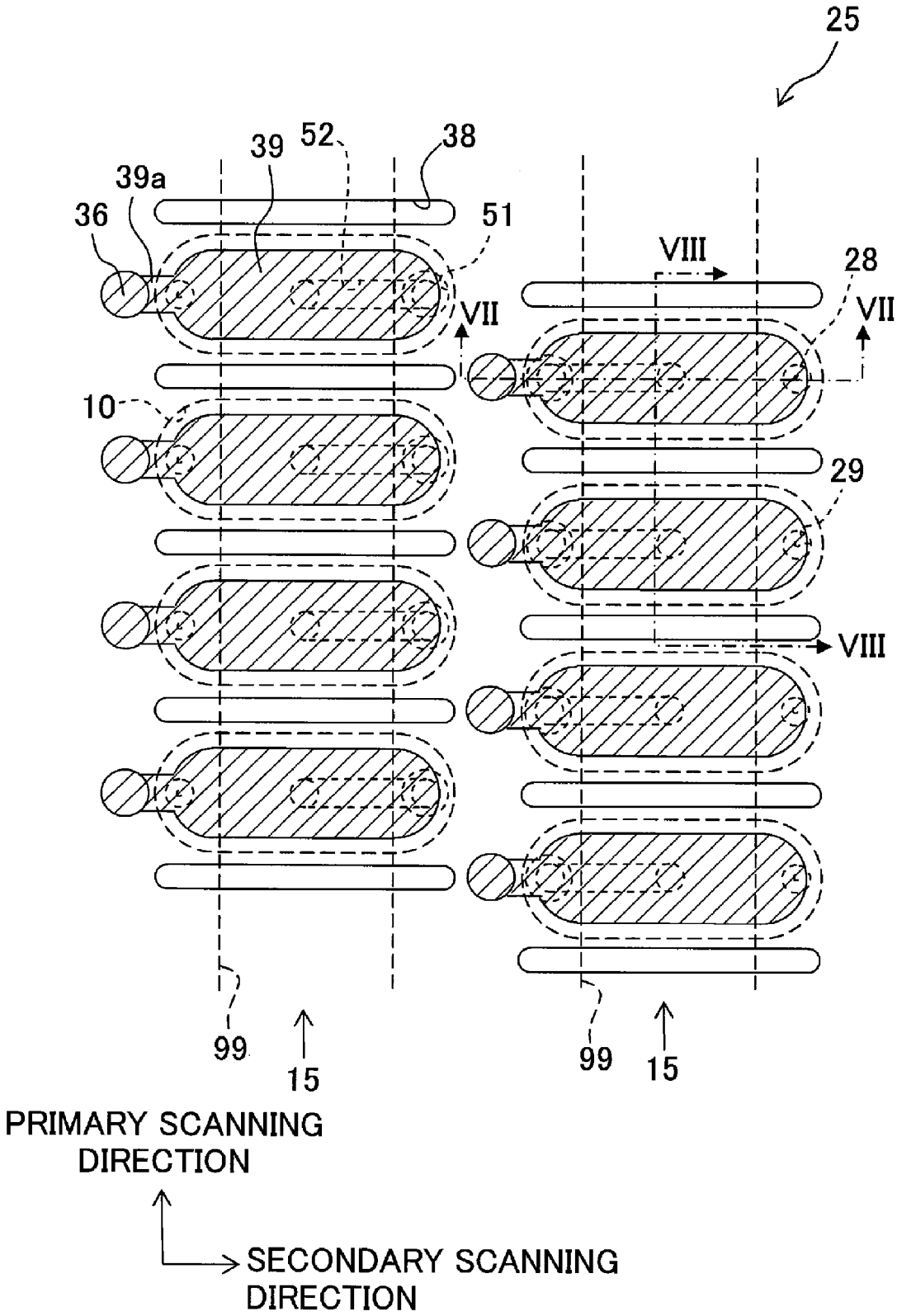
FIG. 6 is a partial plan view of the head body.
Figure 7:
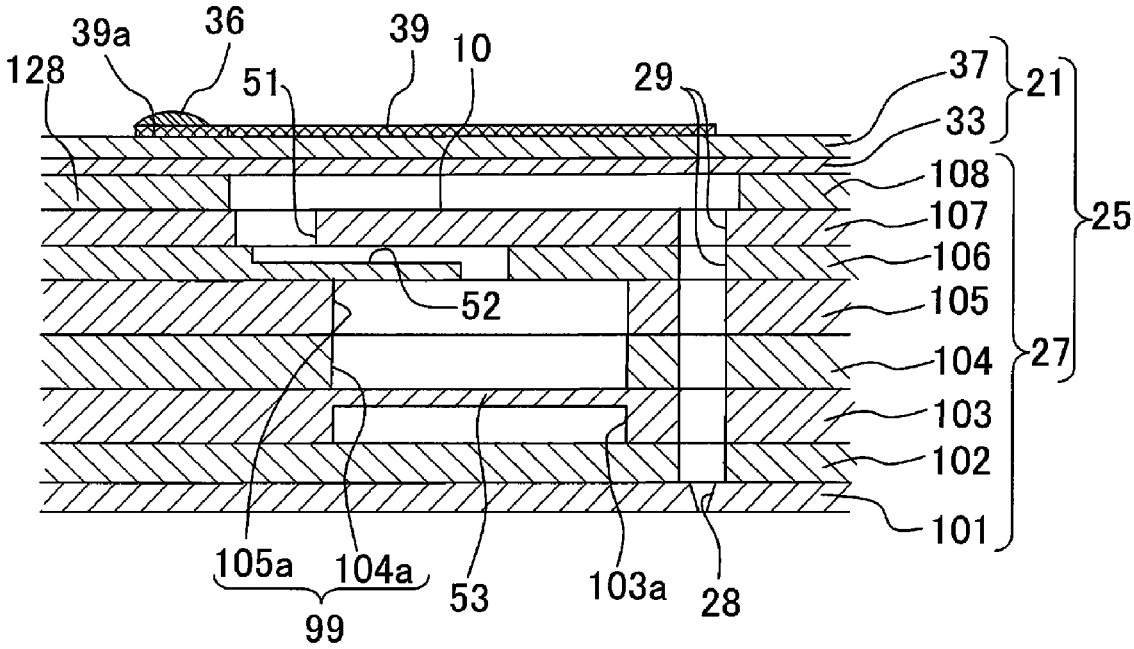
FIG. 7 is a cross-sectional view taken along the VII-VII line in FIG. 6.
Figure 8:
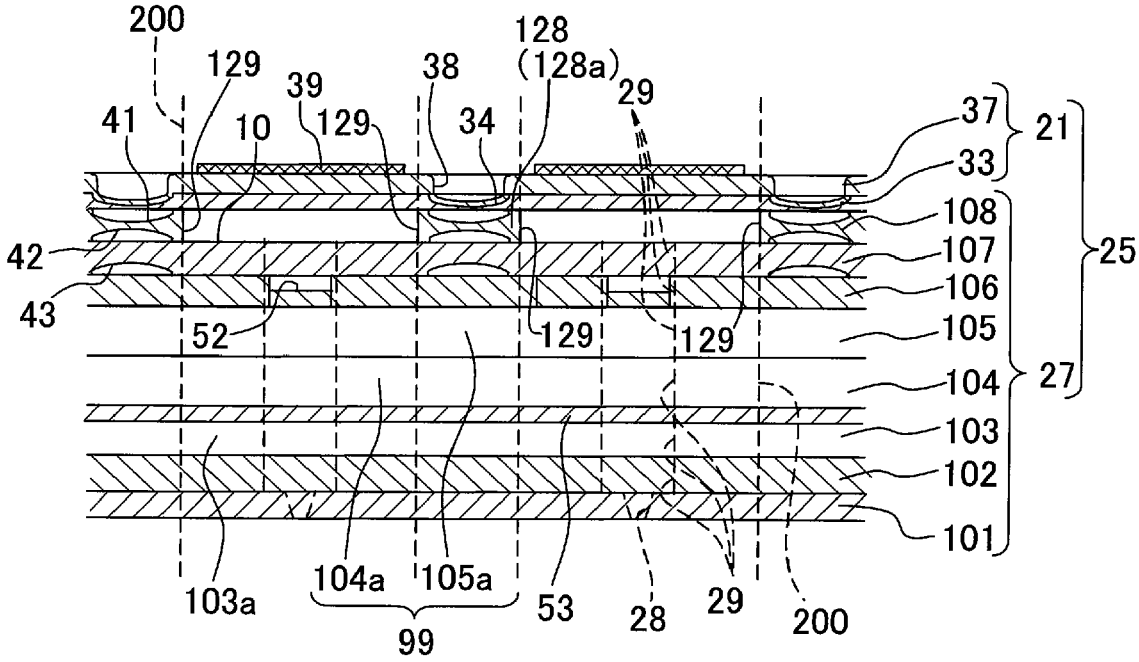
FIG. 8 is a cross-sectional view taken along the VIII-VIII line in FIG. 6.

FIG. 6 is a partial plan view of the head body 25. FIG. 7 is a cross-sectional view taken along the VII-VII line in FIG. 6. FIG. 8 is a cross-sectional view taken along the VIII-VIII line in FIG. 6. As shown in FIGS. 5 and 6, in the nozzle plate 101, a large number of nozzles 28 having a minute diameter are formed at minute intervals. These nozzles 28 are arranged in a zigzag form in five rows along a longitudinal direction (secondary scanning direction) of the nozzle plate 101.

In the cavity plate 108, a plurality of pressure chambers 10 are formed corresponding to the nozzles 28 respectively. The pressure chambers 10 are arranged in a zigzag form along a longitudinal direction of the cavity plate 108, and constitute five pressure-chamber rows 15. Further, pressure chambers 10 belonging to each of the pressure chamber rows 15 are arranged at even intervals along the secondary scanning direction. Each of the pressure chambers 10 is long in the primary scanning direction. In other words, a longitudinal direction of each of the pressure chambers 10 is orthogonal to the longitudinal direction of the cavity plate 108. One ends of the pressure chambers 10 communicate with the nozzles 28 respectively, formed in the nozzle plate 101, via through holes 29 having a small diameter, and formed in a zigzag form arrangement in the supply plate 107, the aperture plate 106, the two manifold plates 104, 105, the damper plate 103 and the cover plate 102. On the other hand, the other ends of the pressure chambers 10 communicate with manifolds (ink chamber half portion) 105*a* (common ink chamber 99) of the manifold plate 105, respectively, via communicating holes 51 of the supply plate 107 and apertures 52 of the aperture plate 106.

Further, in upper surfaces (the other surface: plane) of a partition wall 128 defining the pressure chambers 10 of the cavity plate 108 (namely, an area of the cavity plate 108 in which the pressure chambers 10 are not formed), grooves 41 are formed. Each of the grooves 41 is open upward in the secondary scanning direction on both sides of one of the pressure chambers 10. In other words, each of the grooves 41 is formed, in the secondary scanning direction, not only at an area (column portion 128*a* separating two pressure chambers 10) between the pressure chambers 10 of the cavity plate 108, but also in the partition wall 128 disposed outside, in the secondary scanning direction (one direction), of one of the pressure chambers 10 arranged at opposite ends in each of the pressure-chamber rows 15. Further, as shown in FIG. 5, each of the grooves 41 extends along the longitudinal direction of one of the pressure chambers 10. As shown in FIG. 8, each of the grooves 41 is formed at a position separated and away from a wall surface 129 of one of the partition walls 128 surrounding one of the pressure chambers 10. Specifically, each of the grooves 41 has a width of 50% to 80% of the width of a column portion 128*a* of the partition wall 128 in the secondary scanning direction (a direction connecting pressure chambers 10 belonging to each of pressure-chamber rows 15 with each other)

As shown in FIG. 8, a plurality of grooves 42 opening downward are formed at areas on a lower surface (one surface: plane), of the cavity plate 108, which overlap the grooves 41 in a stacking direction. Note that each of the grooves 42 has a shape symmetrical with one of the grooves 41. Further, as shown in FIG. 5, four holes 108*a* are formed at one end of the cavity plate 108 to be separated along a short direction (primary scanning direction) of the cavity plate 108.

As shown in FIG. 5, five manifolds 105*a* are formed as through holes in the manifold plate 105 among the two manifold plates 104, 105, and arranged on a side near to the aperture plate 106. These five manifolds 105*a* extend along a longitudinal direction of the manifold plate 105 and separated from each other in a short direction of the manifold plate 105.

On the other hand, five manifolds 104*a* having shapes similar to the five manifolds 105*a* are formed as through holes also in the manifold plate 104 among the two manifold plates 104, 105, and arranged on a side near to the damper plate 103. When the two manifold plates 104, 105 having such structures, the aperture plate 106 and the damper plate 103 are stacked, the manifolds 104*a*, 105*a* facing each other are connected to each other as shown in FIG. 7, and further, openings on top and bottom of the connected manifolds 104*a*, 105*a* are covered from top and bottom respectively by the aperture plate 106 and the damper plate 103. Accordingly, five common ink chambers (manifolds) 99 are formed between and outside rows of the through holes 29. Note that one end of each of the common ink chambers 99 is formed in an area overlapping one of the ink supply ports 30*a*.

The communicating holes 51 formed as through holes in the supply plate 107 are arranged in five rows in a zigzag form along a longitudinal direction of the supply plate 107, corresponding to the pressure chambers 10 respectively. Further, as shown in FIGS. 5 and 8, grooves 43 having the same shapes as the grooves 42 are formed respectively in areas, on a lower surface of the supply plate 107, and which overlap the grooves 41, 42 in the stacking direction of the plates. Specifically, each of the grooves 43 is formed in an area (overlapping area) of the supply plate 107 which overlaps the partition wall 128 of the cavity plate 108. In other words, the grooves 43 are formed at positions, on the supply plate 107, each of which is separated and away from virtually extended planes 200 extending the wall surfaces 129 in a plane direction thereof. Further, as shown in FIG. 5, four holes 107*a* are formed, at one end of the supply plate 107 in the longitudinal direction. These holes 107*a* are formed so as to face the four holes 108*a* of the cavity plate 108, respectively.

In addition to the through holes 29, there are arranged in the aperture plate 106 in a zigzag form in a longitudinal direction of the aperture plate 106, five rows of apertures 52, which extend in a short direction of the aperture plate 106 to correspond to the pressure chambers 10, respectively, and having a substantially rectangular shape in a plan view. The apertures 52 communicate via one ends thereof with the communicating holes 51 respectively, and communicate via the other ends thereof with the common ink chambers 99. Note that, as shown in FIG. 6, one end of each of the apertures 52 overlaps an end of a corresponding pressure chamber 10, and the other end of the aperture 52 overlaps a center portion of the corresponding pressure chamber 10. The cross-sectional area of each of the apertures 52 (a cross-sectional area in a direction orthogonal to an ink flowing direction) is small, and limits the flow of ink which is about to flow back to a side of the common ink chamber 99 from one of the pressure chambers 10 when ink is jetted. Further, holes 106*a* are formed at positions each facing one of the four holes 107*a* of the aperture plate 106. Each of the holes 106*a* communicates with one of the holes 107*a* and one of the common ink chambers 99.

Note that among the four holes 106*a*, the three holes 106*a* on the near and front side in FIG. 5 communicate with three common ink chambers 99 on the near and front side in FIG. 5 respectively, and the remaining one hole 106*a* communicates with two common ink chambers 99 on the far side in FIG. 5. In other words, among the five common ink chambers 99, ink is supplied from one of the ink supply ports 30*a* to the two common ink chambers 99 located on the far side in FIG. 5, and to the other three common ink chambers 99, ink is supplied from ink supply ports 30*a* corresponding thereto respectively. In this embodiment, black ink is supplied to the two common ink chambers 99 on the far side in FIG. 5. Furthermore, yellow ink, magenta ink and cyan ink are supplied to the remaining three common ink chambers 99 respectively.

As shown in FIG. 5, damper grooves 103*a* are formed in five rows at an area of the damper plate 103 which overlaps the manifolds 104*a*, 105*a* (common ink chambers 99). As shown in FIG. 7, these damper grooves 103*a* are formed to open only toward the cover plate 102, and have a shape same as the common ink chambers 99 in a plan view. Therefore, when the manifold plates 104, 105 and the damper plate 103 are joined, dampers 53 are located in the damper plate 103 at the area which faces the common ink chambers 99. Note that each of the dampers 53 is a bottom surface of one of the damper grooves 103*a*, and the dampers 53 can vibrate freely on a side of the common ink chamber 99 and a side of the damper groove 103*a* because the dampers 53 are formed to be elastically deformable. Therefore, even when pressure fluctuation generated in the pressure chambers 10 at the time of jetting ink is propagated to the common ink chambers 99, the dampers 53 can be deformed elastically correspondingly to thereby absorb and damp the pressure fluctuation (pressure wave).

A plurality of ink channels are formed inside the channel unit 27. Each of the ink channels reaches one of the nozzles 28 from the ink supply ports 30*a*, through one of the common ink chambers 99, one of the apertures 52, one of the communicating holes 51, one of the pressure chambers 10 and one of the through holes 29 in this order. The ink flowing from the buffer tank 48 into the channel unit 27 via the ink supply ports 30*a* is stored in the common ink chambers 99. Then, the ink is supplied to each of the pressure chambers 10 via the apertures 52, respectively. The ink to which pressure is applied in each of the pressure chambers 10 by the piezoelectric actuator 21 is jetted from a corresponding nozzle 28 via one of the through holes 29.

Next, the piezoelectric actuator 21 will be explained. As shown in FIGS. 5 to 8, the piezoelectric actuator 21 includes a vibration plate 33 having a substantially rectangular shape which is same as that of the cavity plate 108 in a plan view; a piezoelectric layer 37 formed continuously on an upper surface of the vibration plate 33 to cover the pressure chambers 10; and a plurality of individual electrodes 39 formed on an upper surface of the piezoelectric layer 37 corresponding to the pressure chambers 10, respectively.

The vibration plate 33 is formed of a metal material such as an iron-based alloy including stainless steel, a nickel alloy, an aluminum alloy, a titanium alloy or the like, and is diffusion-bonded to an upper surface of the cavity plate 108 to cover all the pressure chambers 10. This vibration plate 33 faces the individual electrodes 39, serves also as a common electrode which makes an electric field act in the piezoelectric layer 37 between the individual electrodes 39 and the vibration plate 33, and is grounded in an unillustrated area to be held at a ground potential. Further, groves 34 having a shape same as the grooves 41 in a plan view are formed on the upper surface of the vibration plate 33 at areas overlapping with the grooves 41 respectively in the stacking direction. In other words, the grooves 34 are formed on the vibration plate 33 at positions separated and away from the virtually extended planes 200 extending the wall surfaces 129 in the plane direction thereof. Further, four holes 33*a* which are to be the ink supply holes 30*a* are formed at one end of the vibration plate 33. These four holes 33*a* are arranged to face the holes 108*a* respectively.

The piezoelectric layer 37 is mainly composed of lead zirconate titanate (PZT) that is a solid solution of lead titanate and lead zirconate, and also is a ferroelectric. The piezoelectric layer 37 is formed on the upper surface of the vibration plate 33, and is formed continuously to cover the pressure chambers 10. Accordingly, the piezoelectric layer 37 can be formed at once for all the pressure chambers 10, thereby simplifying the formation of the piezoelectric layer 37. However, grooves 38 are formed on the piezoelectric layer 37 at positions corresponding to the grooves 34 formed in the vibration plate 33. The grooves 38 have a shape similar to that of the grooves 34 in a plan view. As shown in FIGS. 7 and 8, a thickness of the piezoelectric layer 37 in each of the grooves 38 is smaller than a thickness of the piezoelectric layer 37 in areas other than the grooves 38.

As shown in FIG. 6, on the upper surface of the piezoelectric layer 37, the individual electrodes 39 are formed to correspond to the pressure chambers 10 respectively. Each of the individual electrodes 39 has an elliptic shape and is smaller in size to some extent than the pressure chambers 10. Each of the individual electrodes 39 is formed at a position which overlaps in a plan view with a center portion of one of the pressure chambers 10 to which the individual electrode corresponds. In other words, the individual electrodes 39 are also arranged in five rows in a zigzag form arrangement similarly to the pressure chambers 10. The individual electrodes 39 are formed of a conductive material such as gold, copper, silver, palladium, platinum, titanium or the like. Further, lead-out portions 39*a* are formed on the upper surface of the piezoelectric layer 37. Each of the lead-out portions 39*a* is drawn from one end (left end in FIG. 6) of one of the individual electrodes 39, to the partition wall 128 which does not face one of the pressure chambers 10 in a plan view. Further, circular lands 36 are formed on the lead-out portions 39*a*, respectively. The lands 36 are formed of gold including glass frit and electrically connected to the wires 72 of the FPC 70 respectively.

Next, operation of the piezoelectric actuator 21 at the time of jetting ink will be explained. When printing an image or the like on a paper P, a print signal is supplied from the control board 84 to the driver IC 80. Then, the driver IC 80 converts the print signal into a drive signal and outputs it to each of the individual electrodes 39. At this time, since the vibration plate 33 is kept at the ground potential, a potential difference is generated between the vibration plate 33 and the individual electrodes 39. Then, in an area of the piezoelectric layer 37 sandwiched between the individual electrode 39 and the vibration plate 33, an electric field in a thickness direction is generated, and the area of the piezoelectric layer 37 contracts in a direction perpendicular to the thickness direction which is a polarization direction in which the piezoelectric layer 37 is polarized, namely, the horizontal direction. Along with the contraction of the piezoelectric layer 37 in the horizontal direction, distortion in the stacking direction is generated in the area of the vibration plate 33 and the piezoelectric layer 37 facing a pressure chamber 10 corresponding to the individual electrode 39. Accordingly, volumes of the pressure chamber 10 change to apply pressure to the ink inside the pressure chamber 10. In this manner, the ink is jetted from a nozzle 28 corresponding to the individual electrode 39, thereby performing predetermined printing on the paper P.

Figure 9A:
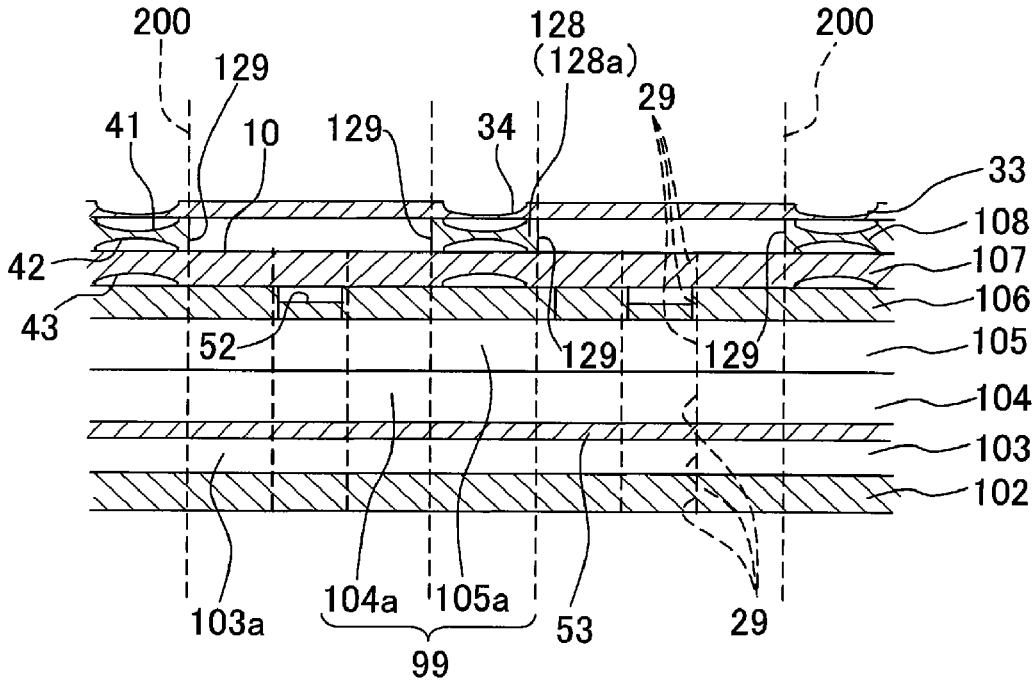
FIG. 9A is a drawing showing a production step for forming plates and stacking the plates so as to define a space.

Next, a method of producing the ink-jet head 30 will be explained below with reference to FIGS. 9A, 9B, 10A and 10B. FIGS. 9A, 9B, 10A and 10B are drawings showing production steps for the ink-jet head 30. For producing the ink-jet head 1, first, holes to be ink channels are formed by etching in the vibration plate 33 and in the seven plates 102 to 108 except the nozzle plate 101 among eight plates 101 to 108 constructing the channel unit 27. Then, the grooves 34, 41, 42, 43 are formed by half etching in the vibration plate 33, the cavity plate 108 and the supply plate 107, respectively. At this time, the grooves 34, 41, 42, 43 formed in the vibration plate 33, the cavity plate 108 and the supply plate 107, respectively are formed in areas separated and away from the wall surfaces 129 of the partition wall 128 and the virtually extended planes 200 in the plane direction of the wall surfaces 129 when these three plates are stacked (space forming step). Thus, the seven plates 102 to 108 and the vibration plate 33 are formed (plate forming step). Next, as shown in FIG. 9A, the seven plates 102 to 108 are positioned and stacked so as to form a plurality of ink channels in the plates, and further the cavity plate 108 and the vibration plate 33 are positioned and stacked so that the grooves 41, 42 formed on the upper surface of the cavity plate 108 overlap the grooves 34 formed in the vibration plate 33 (stacking step). At this time, the positioning of the respective plates 102 to 108 and the vibration plate 33 is performed based on unillustrated positioning marks formed in the plate forming step.

Figure 9B:
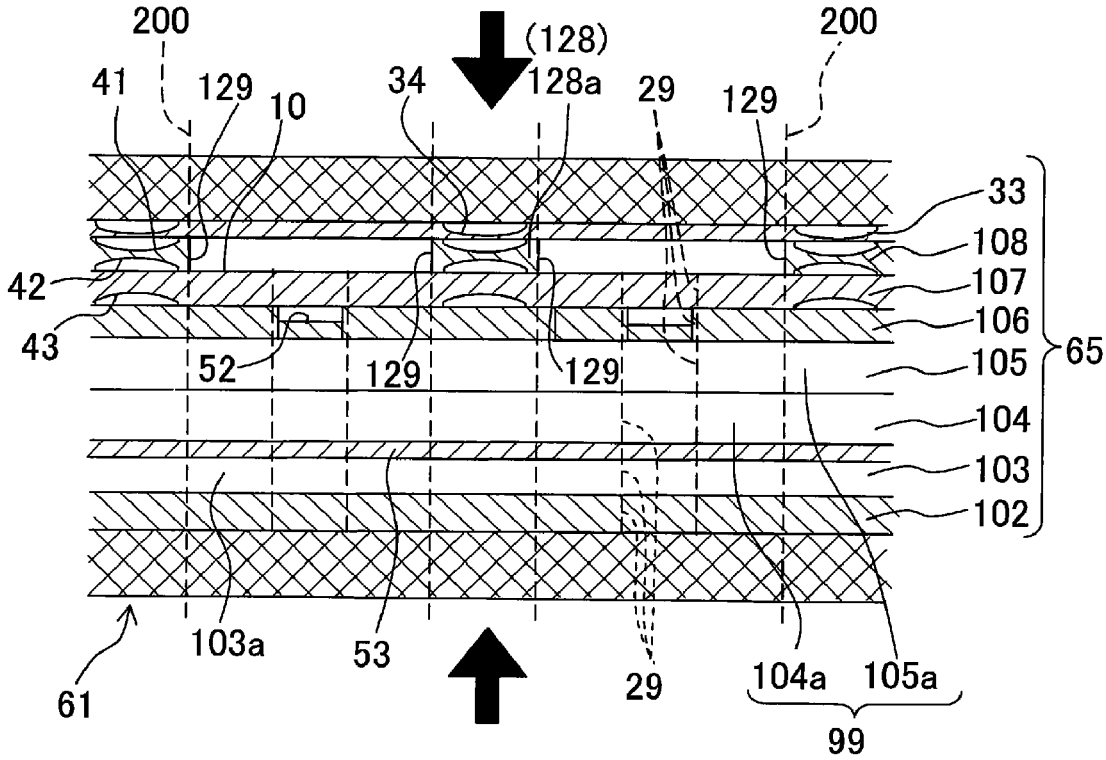
FIG. 9B is a drawing showing a bonding step.

Next, the stacked seven plates 102 to 108 and the vibration plate 33 are heated to a predetermined temperature, and as shown in FIG. 9B, the entire upper surface of the vibration plate 33 and the entire lower surface of the cover plate 102 are sandwiched by a pair of upper and lower jigs 61 having a plate form, so as to press the vibration plate 33 and the seven plates 102 to 108 in the stacking direction (the direction orthogonal to the upper and lower surfaces of the cavity plate 108). At this time, the stacked seven plates 102 to 108 and the vibration plate 33 may be pressed after being heated to a predetermined temperature in advance, or the stacked seven plates 102 to 108 and the vibration plate 33 may be heated to a predetermined temperature while they are being pressed. In this manner, a stack 65 is formed in which the respective plates 102 to 108 and vibration plate 33 each formed of metal are bonded by diffusion-bonding (bonding step). At this time, since strength is decreased in portions of the cavity plate 108, the supply plate 107 and the vibration plate 33 where the grooves 34, 41, 42, 43 are formed, the pressing force exerted by the jigs 61 is not easily transmitted to the portions of these plates in which the grooves 34, 41, 42, 43 are formed. However, the pressing force is transmitted in a concentrated manner to wall surface-vicinity areas in the column portions 128*a* (areas of the column portions 128*a* in which the grooves 41, 42 are not formed) of the cavity plate 108 and to areas in the vibration plate 33 and the supply plate 107 which overlap the wall surface-vicinity areas in the stacking direction (areas which overlap the column portions 128*a* in the stacking direction and in which the grooves 34, 43 are not formed), thereby making it possible to perform diffusion-bonding for the plates 102 to 108 and the vibration plate 33 with sufficient strength.

Figure 10A:
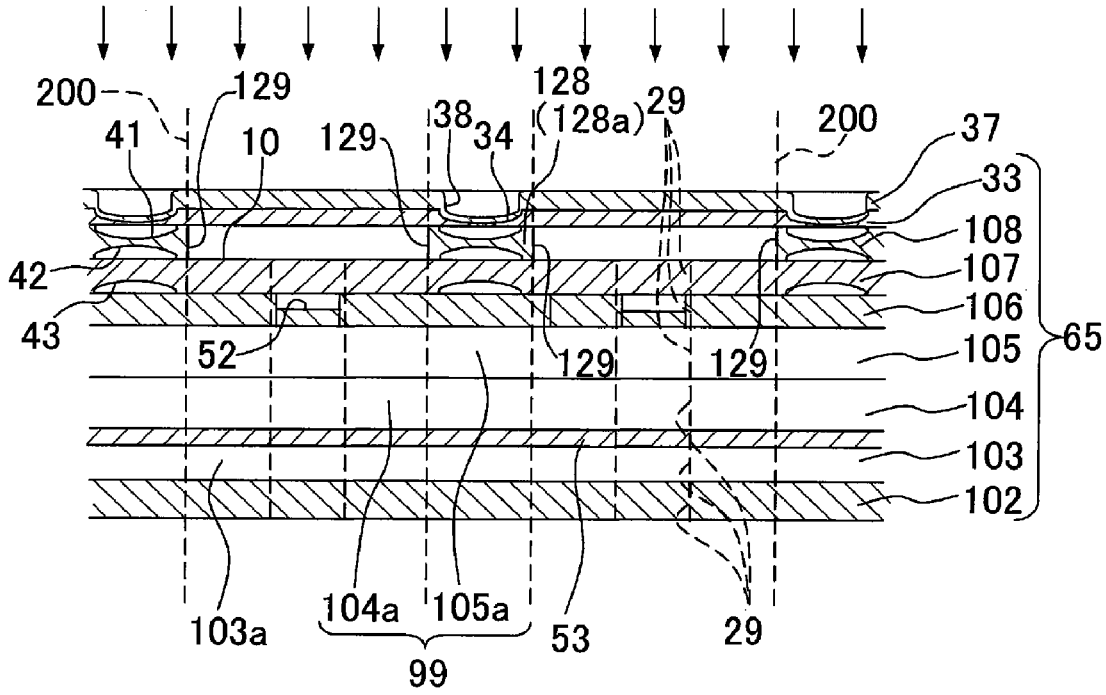
FIG. 10A is a drawing showing a production step for forming a piezoelectric layer.

Next, as shown in FIG. 10A, the piezoelectric layer 37 is formed on an upper surface of the stack 65 (the upper surface of the vibration plate 33). Here, in the step for forming the piezoelectric layer 37, the piezoelectric layer 37 is formed by depositing particles of PZT on the upper surface of the vibration plate 33 from above by a chemical vapor deposition (CVD method), an aerosol deposition (AD method), or the like. At this time, in the areas of the vibration plate 33 in which the grooves 34 are formed, the piezoelectric layer 37 takes a form of recess, and thus the grooves 38 having the shape similar to the grooves 34 in a plan view are formed.

Thus, by using the CVD method or the AD method, the piezoelectric layer 37 on the surfaces of the grooves 34 can be formed thinner than the piezoelectric layer 37 on areas other than the grooves 34. Therefore, the thicknesses of areas of the vibration plate 33 and the piezoelectric layer 37 in which the grooves 34 and 38 are formed, respectively, become further thinner, thereby making it possible to suppress the crosstalk.

Figure 10B:
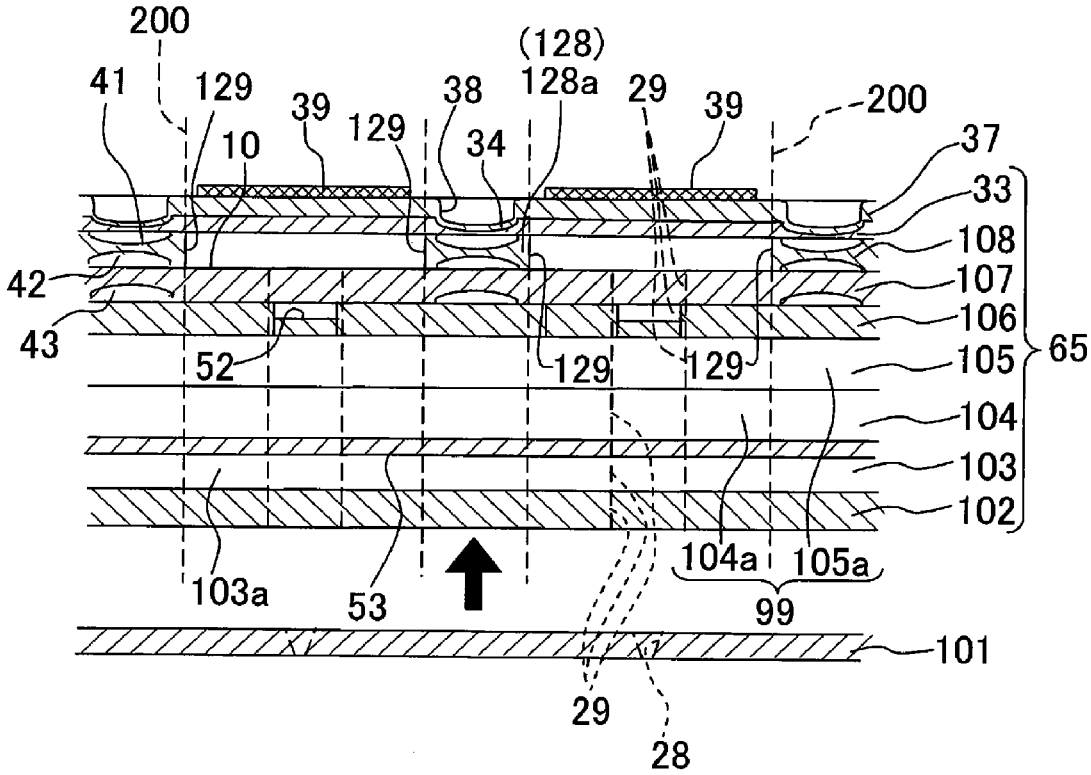
FIG. 10B is a drawing showing a production step for forming electrodes and for joining a nozzle plate.

Next, as shown in FIG. 10B, the individual electrodes 39 are formed on the upper surface of the piezoelectric layer 37, in areas which overlap the pressure chambers 10 respectively in plan view, by using a screen printing method, a deposition method, or a sputtering method. Then, the nozzle plate 101 in which the nozzles 28 are formed by laser processing is bonded with an adhesive to a lower surface of the stack 65 (lower surface of the cover plate 102) as shown in FIG. 10B, thereby completing production of the head body 25.

Thereafter, the wires 72 of the FPC 70 and the individual electrodes 39 are electrically connected with solder or the like, and thus the production of the ink-jet head 30 is completed.

Note that in the above-described production processes of the ink-jet head 30, the cavity plate 108 and at least one of the vibration plate 33 and the supply plate 107 may be stacked. At this time, the vibration plate 33 and/or the supply plate 107 are/is stacked on the cavity plate 108 so that the grooves 34, 43 of the vibration plate 33 and/or the supply plate 107 are arranged at positions separated and away from the virtually extended planes 200 of the wall surfaces 129 of the partition wall 128. Then, a stack of these plates may be heated to a predetermined temperature while being sandwiched by the above-described jigs 61 to be pressed in the stacking direction. In other words, instead of diffusion-bonding the seven plates 102 to 108 and the vibration plate 33 all at once, the cavity plate 108 and the vibration plate 33 and/or the supply plate 107 may be diffusion-bonded. In this case, since only the vibration plate 33 and/or the supply plate 107 exist between the jigs 61 and the cavity plate 108, the cavity plate 108 and the vibration plate 33 and/or the supply plate 107 are diffusion-bonded in a state that the wall surface-vicinity areas in the column portions 128*a* in the cavity plate 108 and the areas in the vibration plate 33 and/or the supply plate 107, overlapping the wall surface-vicinity areas, are in secure contact with each other. Accordingly, any gap is hardly formed on the periphery of each of the pressure chambers 10.

As described above, in the ink-jet head 30 according to this embodiment, the grooves 34, 41, 42, 43 which are to be spaces are formed in the areas of the cavity plate 108 that are separated and away from the wall surfaces 129 of the partition wall 128 and in the areas of the vibration plate and the supply plate 107 that are separated and away from the virtually extended planes 200 of the wall surfaces 129. As a result, the wall surface-vicinity areas in the upper and lower surfaces of the cavity plate 108 and the areas in the vibration plate 33 and the supply plate 107 which overlap the wall surface-vicinity areas in the stacking direction easily come in contact when the cavity plate 108 is sandwiched and pressed by the vibration plate 33 and the supply plate 107 in the bonding step. Accordingly, the areas in the vicinity of wall surface 129 of the cavity plate 108 and one of the vibration plate 33 and the supply plate 107 are bonded together, and any gap is hardly formed on the periphery of each of the pressure chambers 10. Therefore, on the periphery of the pressure chambers 10, any gap continuing to the pressure chamber 10 is hardly formed, thereby preventing air from remaining in the pressure chambers 10 which would otherwise deteriorate the ink jetting characteristic.

Further, the ink-jet head 30 partially deforms the vibration plate 33 and the piezoelectric layer 37, which face the pressure chambers 10, to change the volumes of the pressure chambers 10, thereby applying pressure to the ink inside the pressure chambers 10. When the grooves 34 (spaces) are formed in the areas of the vibration plate 33 which overlap the column portions 128*a* of the cavity plate 108 in the stacking direction, the areas of the vibration plate 33 in which the grooves 34 are formed have a thickness smaller than thicknesses of other areas. Accordingly, the partial deformation of the vibration plate 33 and the piezoelectric layer 37 facing a certain pressure chamber 10 is hardly propagated to the portions of the vibration plate 33 and the piezoelectric layer 37 facing another pressure chamber 10 adjacent to the certain pressure chamber 10. Therefore, the crosstalk can be suppressed.

Further, since only the vibration plate 33 exists between the jigs 61 and the cavity plate 108, the formation of the grooves 34 in the vibration plate 33 makes secure bonding of the wall surface-vicinity areas in the upper surface of the cavity plate 108 and the areas in the vibration plate 33 which overlap the wall surface-vicinity areas. Accordingly, the vibration plate 33 and the piezoelectric layer 37 which face the pressure chambers 10 can be stably deformed.

Further, since the grooves 34 are formed in the upper surface of the vibration plate 33, the grooves 38 are formed in the piezoelectric layer 37, and the portions in which the grooves 38 are formed have small thickness. Accordingly, the cross talk can be suppressed further.

Furthermore, since the width of each of the grooves 34, 41, 42, 43 is 50% to 80% of the width of each of the column portions 128*a* in the secondary scanning direction, it is possible to securely bond the areas in the vicinity of wall surfaces 129 in the upper and lower surfaces of the cavity plate 108 and the areas in the vibration plate 33 and the supply plate 107 which overlap the wall surface-vicinity areas. If the width of each of the grooves 34, 41, 42, 43 is less than 50% of the width of the column portion 128*a*, then the pressing force applied during the bonding step is also distributed to the center portion of each of the column portions 128*a*. Accordingly, it becomes difficult for the wall surface-vicinity areas in the upper and lower surfaces of the cavity plate 108 and the areas in the vibration plate 33 and the supply plate 107 which overlap the wall surface-vicinity areas to come in contact with each other. On the other hand, when the width of each of the grooves 34, 41, 42, 43 exceeds 80% of the width of the column portion 128*a*, contact areas (namely, bonding areas) become small between the wall surface-vicinity areas in the upper and lower surfaces of the cavity plate 108 and the areas in the vibration plate 33 and the supply plate 107 which overlap the wall surface-vicinity areas. The small contact areas are not preferable because the bonding strength among the vibration plate 33, the cavity plate 108 and the supply plate 107 becomes low.

Moreover, since the grooves 41 are formed in the upper surface of the cavity plate 108, the wall surface-vicinity areas in the upper surface of the cavity plate 108 and the areas in the vibration plate 33 which overlap the wall surface-vicinity areas are securely bonded. Further, since the grooves 42 are formed in the lower surface of the cavity plate 108, the wall surface-vicinity areas in the lower surface of the cavity plate 108 and the areas in the supply plate 107 which overlap the wall surface-vicinity areas are securely bonded.

Further, since the grooves 43 are formed in the lower surface of the supply plate 107, the wall surface-vicinity areas in the lower surface of the cavity plate 108 and the areas in the supply plate 107 which overlap the wall surface-vicinity areas are securely bonded.

Furthermore, the grooves 34, 41, 42, 43 are formed not only in the areas (column portions 128*a*) between the pressure chambers 10 belonging to each of the pressure chamber rows 15 of the cavity plate 108 and in the areas of the vibration plate 33 and the supply plate 107 which overlap the column portions 128*a*, but also in areas outside of the pressure chambers 10 in the secondary scanning direction at both ends of each of the pressure chamber rows 15 of the cavity plate 108 and in areas of the vibration plate 33 and the supply plate 107 which overlap the outside areas. Therefore, when a plurality of pressure chambers 10 are arranged to form the pressure chamber rows 15, the areas in the vicinity of the wall surfaces 129 in the pressure chambers 10 at both ends of the pressure chamber rows 15 are bonded with the vibration plate 33 and the supply plate 107.

In this embodiment, the formation of the piezoelectric actuator 21 becomes easy, since the piezoelectric layer 37 is formed on the vibration plate 33 and further the individual electrodes 39 are formed on the piezoelectric layer 37 (in other words, the piezoelectric layer 37 is sandwiched by the vibration plate 33 and the individual electrodes 39). Note that the piezoelectric actuator may be, for example, a piezoelectric actuator including a vibration plate; an insulating film formed on the vibration plate; a plurality of individual electrodes formed respectively on the insulating film at areas which overlap pressure chambers; a piezoelectric layer formed on the individual electrodes and on the insulating film at areas in which the individual electrodes are not formed; and a common electrode formed on the piezoelectric layer so as to sandwich the piezoelectric layer with individual electrodes. In the case of this piezoelectric actuator, a drive signal is supplied to the individual electrodes in a state that the common electrode is at the ground potential, thereby deforming the areas of the piezoelectric layer sandwiched by the common electrode and the individual electrodes in the stacking direction, and accompanying this deformation, the area of the vibration plate facing the above areas deforms. Accordingly, the volumes of the pressure chambers are changed to apply pressure to the ink inside the pressure chambers, thereby jetting the ink from the nozzles.

Figure 11A:
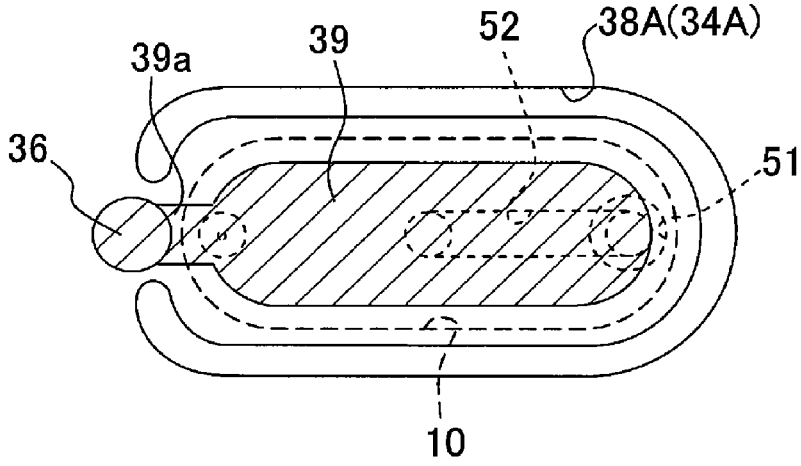
FIG. 11A is a partial plan view of the head body, showing a groove formed around a pressure chamber.
Figure 11B:
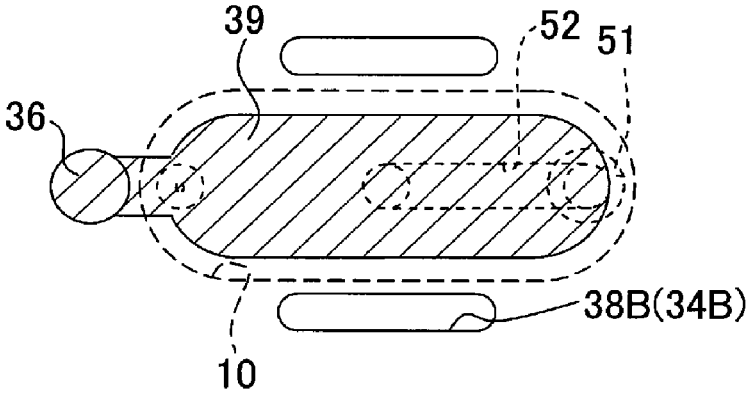
FIG. 11B is a partial plan view of the head body, showing grooves formed each in a portion of a longitudinal direction of the pressure chamber.
Figure 11C:
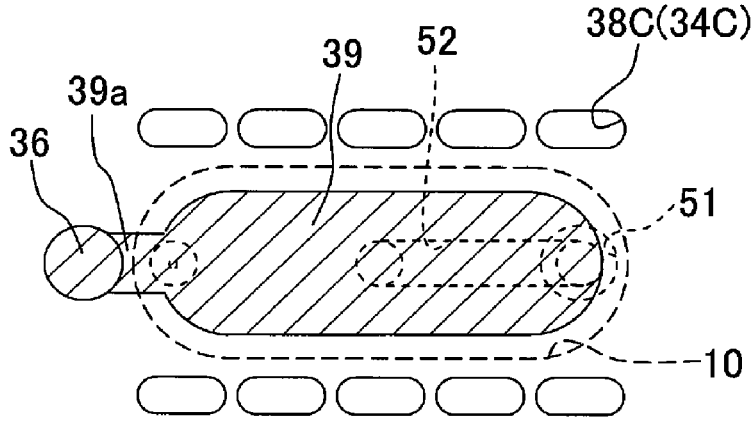
FIG. 11C is a partial plan view of the head body, showing grooves formed in a non-continuous manner, in the longitudinal direction of the pressure chamber.

In the foregoing, the preferred embodiment of the present invention has been explained. The present invention however, is not limited to the above embodiment and can be changed in various ways within the range described in the claims. For example, as shown in FIG. 11A, the shape of grooves 38A, 34A in plan view formed in the piezoelectric layer and the vibration plate respectively may be a substantially ring shape which substantially surrounds one of the pressure chambers. Alternatively, as shown in FIG. 11B, grooves 38B, 34B formed in the piezoelectric layer and the vibration plate respectively may extend along a portion of the pressure chamber 10 in a longitudinal direction of the pressure chamber 10. In other words, the length of each of the grooves 38B, 34B may be shorter than that of one of the pressure chambers 10 in the longitudinal direction. Still alternatively, as shown in FIG. 11C, grooves 38C, 34C formed in the piezoelectric layer and the vibration plate respectively may be arranged in rows along the longitudinal direction of the pressure chamber 10. As described above, the shapes of the grooves in plan view may be any shape, as long as each of the grooves has a portion in the longitudinal direction of the pressure chambers. Note that here, the grooves formed in the piezoelectric layer and the vibration plate are described by way of example, but grooves or through holes may be formed respectively in areas of the cavity plate and the supply plate which overlap the grooves 34A to 34C, for example.

Further, in the above embodiment, the grooves 34, 41, 42, 43 and the like each forming the spaces are formed, but through holes may be formed instead of these grooves. Furthermore, although the grooves 34, 41, 42, 43 and the like are formed in the vibration plate 33, the cavity plate 108 and the supply plate 107, grooves or through holes may be formed in another plate, in addition to or instead of the grooves 34, 41, 42, 43, as long as the grooves or through holes are formed in areas which overlap these grooves 34, 41, 42, 43 and the like in the stacking direction, in other words, at positions separated and away from the virtually extended planes 200 extending the wall surfaces 129 of the partition wall 128 in the plane direction. For example, grooves or through holes may be formed in the aperture plate 106. Moreover, it is allowable that grooves or through holes are formed in the above-described arrangement and shapes only in any one of the vibration plate 33 and the plates 106 to 108. In particular, since the grooves 41 formed in the upper surface of the cavity plate 108 securely bonds the vibration plate 33 and the column portions 128*a* of the cavity plate 108, the grooves 41 not only function to prevent the formation of gaps on the periphery of the pressure chambers 10 but also contribute to stabilizing the deformation of the vibration plate 33. Therefore, the grooves 41 are the most effective among the grooves 34, 41, 42, 43. Further, in the respective plates, grooves or through holes may be formed only in the column portions 128*a* and areas which overlap the column portions 128*a* in the stacking direction. Further, the width of each of the grooves 34, 41, 42, 43 and the like may be less than 50% of the width each of the column portions 128*a* in the secondary scanning direction, or may exceed 80% thereof. Further, the above-described ink-jet head 30 is a serial type head in which the head reciprocates, but the ink-jet head 30 may be a line type head in which the head is fixed. Further, in the above embodiment, an example is shown in which the present invention is applied to an ink-jet head as a liquid jetting head which jets ink from nozzles, but the invention may also be applied to another liquid jetting head which applies pressure to liquid other than ink to jet the liquid.

What is claimed is:

1. A liquid jetting head which jets liquid, comprising:

a channel unit formed by diffusion-bonding plates including a pressure chamber plate made of metal in which a plurality of pressure chambers defined by a partition wall are formed along a plane, and a plurality of channel plates which are made of metal and stacked on a side of one surface of the pressure chamber plate, the channel plates being formed with channels communicating with the pressure chambers; and a piezoelectric actuator which selectively changes volumes of the pressure chambers and which has a vibration plate made of metal and diffusion-bonded on the other surface of the pressure chamber plate to cover the pressure chambers, a piezoelectric layer arranged in the vibration plate on a side opposite to the pressure chambers, and a plurality of individual electrodes arranged in the piezoelectric layer at an area on a side opposite to the pressure chambers and facing the pressure chambers;

wherein a space is formed in an overlapping area, of the vibration plate, the pressure chamber plate, or one of the channel plates, which overlaps the partition wall in a direction orthogonal to the plane.

2. The liquid jetting head according to claim 1, wherein the space is formed in the vibration plate.

3. The liquid jetting head according to claim 2, wherein the space is defined by a groove formed in a surface of the vibration plate which faces the piezoelectric layer.

4. The liquid jetting head according to claim 3, wherein a width of the space is 50% to 80% of a width of a portion of the partition wall which separates two pressure chambers among the pressure chambers and adjacent to each other, the width being in a direction connecting the two of the pressure chambers.

5. The liquid jetting head according to claim 1, wherein the space is formed in the pressure chamber plate.

6. The liquid jetting head according to claim 5, wherein the space is defined by a groove formed in the one surface of the pressure chamber plate.

7. The liquid jetting head according to claim 5, wherein the space is defined by a groove formed in the other surface of the pressure chamber plate.

8. The liquid jetting head according to claim 1, wherein the space is formed in the channel plates.

9. The liquid jetting head according to claim 1, wherein:

the pressure chambers form a pressure chamber row arranged in one direction along the plane; and the space is formed in the overlapping area of the vibration plate, the pressure chamber plate, or one of the channel plates, outside of the pressure chambers at both ends of the pressure chamber row in the one direction.

10. The liquid jetting head according to claim 1, wherein the individual electrodes are arranged on a surface of the piezoelectric layer opposite to the vibration plate, and the individual electrodes sandwich the piezoelectric layer with the vibration plate.

11. The liquid jetting head according to claim 1, wherein each of the pressure chambers has a slender shape, and the space is formed in the overlapping area of the vibration plate, the pressure chamber plate, or one of the channel plates, in a longitudinal direction of the pressure chambers.

12. The liquid jetting head according to claim 1, wherein the space is formed in the overlapping area of the vibration plate, the pressure chamber plate, or one of the channel plates, along a periphery of the pressure chambers.

13. The liquid jetting head according to claim 1, wherein the space is formed as a group of non-continuous spaces arranged in a row in the overlapping area of the vibration plate, the pressure chamber plate, or one of the channel plates.

14. The liquid jetting head according to claim 1, wherein the space is formed on a center in a width direction of the overlapping area of the vibration plate, the pressure chamber plate, or one of the channel plates.

15. The liquid jetting head according to claim 1, wherein the individual electrodes are arranged so as not to overlap the space in the direction orthogonal to the plane.

* * * * *